US008033073B1

(12) United States Patent
Binder

(10) Patent No.: US 8,033,073 B1
(45) Date of Patent: Oct. 11, 2011

(54) ROOF BATTEN SYSTEM

(76) Inventor: Steven Binder, Phoenix, AZ (US)

( * ) Notice: Subject to any disclaimer, the term of this patent is extended or adjusted under 35 U.S.C. 154(b) by 475 days.

(21) Appl. No.: 12/182,005

(22) Filed: Jul. 29, 2008

Related U.S. Application Data

(60) Provisional application No. 60/975,787, filed on Sep. 27, 2007.

(51) Int. Cl.
*E04D 1/00* (2006.01)

(52) U.S. Cl. ..... 52/553; 52/550; 52/302.3; 52/478; 52/309.9; 52/309.15

(58) Field of Classification Search ..... 52/553, 52/408, 409, 302.1, 302.3, 478, 309.4, 309.9, 52/309.14, 309.15
See application file for complete search history.

(56) References Cited

U.S. PATENT DOCUMENTS

| | | | | | |
|---|---|---|---|---|---|
| 1,163,034 | A | * | 12/1915 | Phippen | 52/551 |
| 3,029,172 | A | * | 4/1962 | Glass | 428/316.6 |
| 3,665,664 | A | * | 5/1972 | Watson | 52/211 |
| 3,971,184 | A | * | 7/1976 | Van Wagoner | 428/201 |
| 4,445,306 | A | * | 5/1984 | Schauffele | 52/410 |
| 4,630,421 | A | * | 12/1986 | Diehl et al. | 52/408 |
| 4,658,554 | A | * | 4/1987 | Riley et al. | 52/309.8 |
| 4,718,211 | A | * | 1/1988 | Russell et al. | 52/409 |
| 4,747,247 | A | * | 5/1988 | Petersen et al. | 52/408 |
| 4,996,812 | A | * | 3/1991 | Venable | 52/408 |
| 5,311,716 | A | * | 5/1994 | Houssin | 52/410 |
| 5,369,926 | A | * | 12/1994 | Borland | 52/302.1 |
| 5,471,807 | A | | 12/1995 | Vasquez | |
| 5,540,022 | A | * | 7/1996 | Morris | 52/309.8 |
| 6,226,949 | B1 | * | 5/2001 | Huber | 52/555 |
| 6,357,193 | B1 | | 3/2002 | Morris | |
| 6,718,719 | B1 | * | 4/2004 | Hagerty | 52/553 |
| RE39,825 | E | * | 9/2007 | Morris et al. | 52/553 |
| 2003/0172606 | A1 | | 9/2003 | Anderson | |
| 2005/0000172 | A1 | | 1/2005 | Anderson | |

* cited by examiner

*Primary Examiner* — Eileen D Lillis
*Assistant Examiner* — Chi Nguyen
(74) *Attorney, Agent, or Firm* — Parsons & Goltry; Robert A. Parsons; Michael W. Goltry

(57) ABSTRACT

A roofing system, including at least one composite roof batten structured and arranged to support roof tile over a roof structure. The composite roof batten includes a substantially rigid low-density core, an upper reinforcing layer structured and arranged to reinforce the substantially rigid low-density core, and a lower reinforcing layer structured and arranged to reinforce the substantially rigid low-density core. The composite roof batten having at least one channel structured and arranged to assist the passage of moisture and air therethrough under the roof tile.

14 Claims, 5 Drawing Sheets

216
8
8
133

G
G
224
216
222
130
J
133
133
216
133

ROOF BATTEN SYSTEM

CROSS-REFERENCE TO RELATED APPLICATION

This application claims the benefit of U.S. Provisional Application No. 60/975,787, filed Sep. 27, 2007, entitled "ROOF BATTEN SYSTEM".

FIELD OF THE INVENTION

This invention relates to roof batten systems.

More particularly, the present invention relates to battens used especially in the installation of clay or concrete tile roof assemblies.

BACKGROUND OF THE INVENTION

Typically, clay or concrete tile roof systems are installed over roofing substrates using supportive roof battens. Roof battens are conventionally supplied as nominal 1"×2" wooden strips. Such battens are customarily secured to a sloping roof in a series of horizontal lines. Customarily, battens are secured by nailing, screwing, or stapling.

The use of such traditional roof battens had been shown to produce a number of post-installation problems. Foremost among these is the tendency of such battens to collect water and debris on the underlying roof surface and to inhibit air circulation under the roof tiles. When water and debris migrate through the tile and collect behind the battens, they will often degrade the protective paper or felt underlayment if the water is allowed to remain for any extended duration. This detrimental condition eventually breaks down the underlayment, allowing water to seep to the underlying roof structure, typically leading to further roof deterioration and the potential for damage within the building structure. Inhibiting air circulation under the tiles further contributes to retention of moisture, and allows greater heat build-up adversely impacting temperature control of the structure interior spaces.

The traditional use of wood as a batten material has been, historically, a popular choice due to its inherent low cost. Unfortunately, wood is susceptible to rot, insect damage, and readily retains moisture. Clearly, a durable, low cost, batten system that addresses the above-described problems would be of great benefit to many.

It would be highly advantageous, therefore, to remedy the foregoing and other deficiencies inherent in the prior art.

An object of the present invention is to provide a system of improved synthetic battens for use especially in clay or concrete tile roof systems.

It is another object of the present invention to provide a batten system which permits fluid and air flow.

A further primary object of the present invention is to provide a batten system that is efficient, inexpensive, and handy. Other objects and features of this invention will become apparent with reference to the following descriptions.

SUMMARY OF THE INVENTION

Briefly, to achieve the desired objects and advantages of the instant invention, provided is a system related to improving in-service performance of at least one roof assembly utilizing at least one roof tile, such system comprising: at least one composite roof batten structured and arranged to support at least one roof tile over at least one roof structure; wherein such at least one composite roof batten comprises at least one substantially rigid low-density core comprising at least one upper surface portion and at least one lower surface portion, overlaying such at least one substantially rigid low-density core, at least one upper reinforcing layer structured and arranged to reinforce at least one upper surface portion of such at least one substantially rigid low-density core, and underlaying such at least one substantially rigid low-density core, at least one lower reinforcing layer structured and arranged to reinforce at least one lower surface portion of such at least one substantially rigid low-density core; wherein such at least one substantially rigid low-density core comprises at least one expanded foam material; and wherein such at least upper reinforcing layer and such at least one lower reinforcing layer are firmly adhered to such at least one substantially rigid low-density core. Moreover, it provides such a system wherein such at least one composite roof batten comprises at least one channel, structured and arranged to assist the passage of moisture and air under such at least one composite roof batten.

Additionally, it provides such a system wherein: such at least one composite roof batten comprises at least one elongated bar comprising at least one longitudinal axis; such at least one channel comprises a plurality of spaced openings formed within such at least one substantially rigid low-density core and such at least one lower reinforcing layer; and such plurality of spaced openings assists the passage of the moisture and air through such at least one composite roof batten in a direction generally perpendicular to such at least one longitudinal axis. Also, it provides such a system wherein such at least one elongated bar comprises a length of about 48 inches. In addition, it provides such a system wherein each such plurality of spaced openings comprises a width of between about one inch and about four inches.

Furthermore, it provides such a system wherein such at least one upper reinforcing layer and such at least one lower reinforcing layer each comprise at least one rigid thermoplastic. Further, it provides such a system wherein such at least one upper reinforcing layer and such at least one lower reinforcing layer each comprise at least one Acrylonitrile-Butadine-Styrene (ABS) material. Even further, it provides such a system wherein such at least one expanded foam material comprises at least one Expanded Polystyrene (EPS) material.

In accordance with another preferred embodiment hereof, this invention provides a method related to the production of at least one composite roof batten, such method comprising the steps of: providing at least one sheet of substantially rigid low-density core comprising at least one upper sheet surface and at least one lower sheet surface; providing at least one upper reinforcing sheet and at least one lower reinforcing sheet each one comprising, essentially, at least one plastic material; bonding such at least one upper reinforcing sheet to such at least one upper sheet surface of such at least one substantially rigid low-density core; and bonding such at least one lower reinforcing sheet to such at least one lower sheet surface of such at least one substantially rigid low-density core, wherein at least one reinforced composite sheet is produced, cutting such at least one reinforced composite sheet to produce a plurality of composite roof battens.

Moreover, it provides such a method further comprising the initial step of forming at least one contoured surface shape into such at least one lower sheet surface of such substantially rigid low-density core. Additionally, it provides such a method further comprising the step of thermal vacuum forming such at least one lower reinforcing layer to such at least one lower sheet surface of such at least one substantially rigid low-density core, after the initial step of forming such at least one contoured surface shape into such at least one lower sheet surface of such substantially rigid low-density core. Also, it provides such a method further comprising the step of applying indicia structured and arranged to assist a user in properly locating at least one mechanical fastener used to fasten such composite roof batten to at least one roof structure.

In accordance with another preferred embodiment hereof, this invention provides a system related to improving in-service performance of at least one roof assembly utilizing at least one roof tile, such system comprising; at least one composite roof batten structured and arranged to support the at least one roof tile over at least one roof structure; wherein such at least one composite roof batten comprises at least one substantially continuous upper contact surface structured and arranged to supportively contact the at least one roof tile, at least two lower contact surfaces each one structured and arranged to contact the at least one roof structure, at least one intermediate positioner structured and arranged to maintain the position of such at least one substantially continuous upper contact surface relative to such at least two lower contact surfaces, and at least one passage structured and arranged to assist the passage of moisture and air through such at least one composite roof batten; wherein such at least one moisture passage spans between such at least two lower contact surfaces; wherein such at least one intermediate positioner comprises at least one substantially rigid core material comprising a first material density; wherein such at least upper contact surface and such at least two lower contact surfaces each comprise at least one substantially rigid sheet material having at least on second material density greater than such first material density; and wherein each such at least one substantially rigid sheet material is firmly adhered to such at least one substantially rigid core material.

In addition, it provides such a system wherein such at least one composite roof batten comprises a longitudinal length of about four feet and a transverse width of at least about one inch. And, it provides such a system wherein such at least one composite roof batten comprises an overall thickness of about ¾ inch. Further, it provides such a system wherein each one longitudinal length of between about ½ inch and about four inches. Even further, it provides such a system wherein such at least one moisture passage comprises an opening width of at least about three inches and an opening height of about ½ inch. Even further, it provides such a system wherein: such at least one substantially rigid core material comprises at least one mold-formed cellular foam; such at least one mold-formed cellular foam is mold formed to comprise at least one contoured surface shape; and such at least one contoured surface shape at least comprises such at least one moisture passage and such at least two lower contact surfaces.

Even further, it provides such a system wherein each such at least one substantially rigid sheet material is firmly adhered to such at least one substantially rigid core material using a least one contact adhesive. Even further, it provides such a system wherein each such at least one substantially rigid sheet material is firmly adhered to such at least one substantially rigid core material using a least one hot-melt adhesive. Even further, it provides such a system wherein such at least one substantially rigid core material comprises at least one Expanded Polystyrene Foam having a density of between about ¾ pounds per cubic foot and about three pounds per cubic foot. In addition, it provides each and every novel feature, element, combination, step and/or method disclosed or suggested by this patent application.

DETAILED DESCRIPTION OF THE PREFERRED EMBODIMENTS

Figure 1:
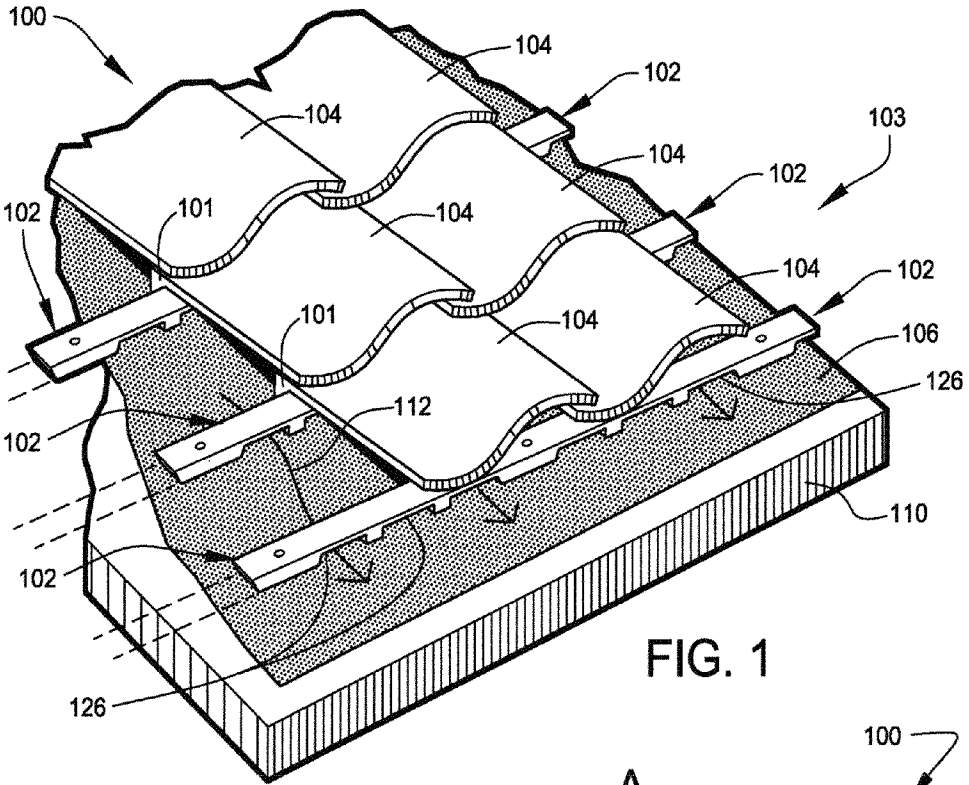
FIG. 1 shows a partial cut-away perspective view, illustrating a preferred installation of a composite roof batten integrated within a roof assembly, according to a preferred embodiment of the present invention.

FIG. 1 shows a cut-away perspective view illustrating a preferred installation of composite roof batten 102 according to a preferred embodiment of the present invention. Preferably, composite roof batten 102 is a preferred embodiment within roof batten system 100. Preferably, composite roof batten 102 is utilized to install roofing tile 104 of a type having a lip or lug 101 that is preferably engaged over composite roof batten 102, as shown. The preferred structures and arrangements of composite roof batten 102 are designed to provide a batten construction that is substantially resistant to rot and insect damage. Furthermore, the preferred structures and arrangements of composite roof batten 102 are designed to readily shed moisture and permit airflow under roofing tiles 104, as described below.

Preferably, composite roof batten 102 is placed over a flexible water-resistant underlayment 106 and mechanically fastened to roof substrate 110, as shown. Preferably, composite roof batten 102 is installed in an orientation substantially perpendicular to the slope of roof system 103, as shown. Preferably, composite roof batten 102 comprises at least one passage/channel to facilitate the movement of moisture and air 112 through battens 102, as shown.

Figure 2:
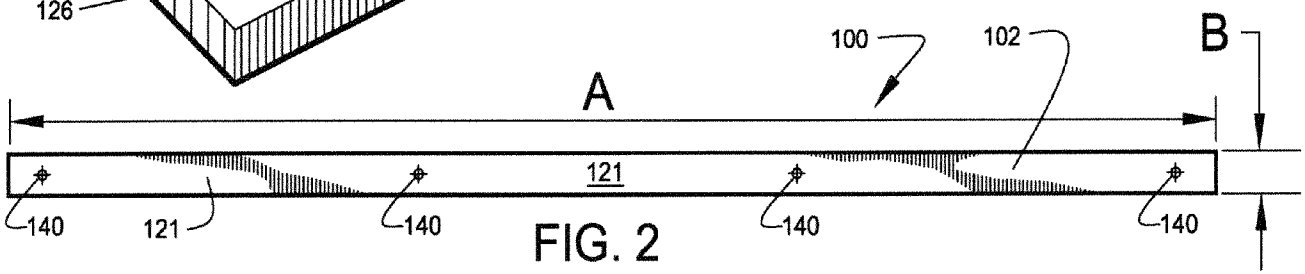
FIG. 2 shows a top view, illustrating the composite roof batten, according to the preferred embodiment of FIG. 1.
Figure 3:
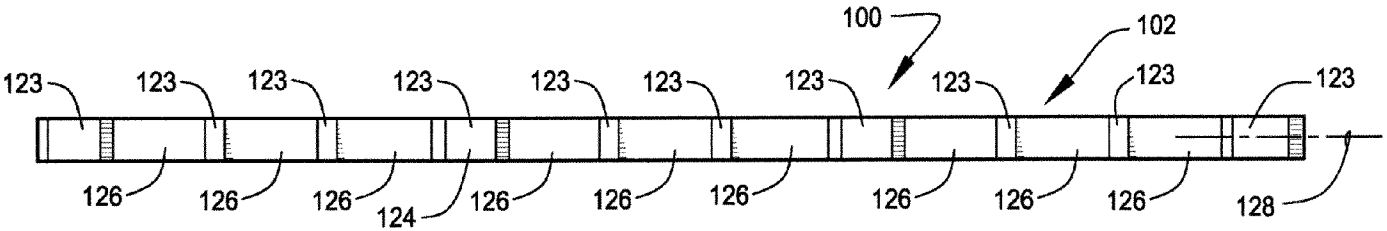
FIG. 3 shows a bottom view, illustrating the composite roof batten, according to the preferred embodiment of FIG. 1.
Figure 4:
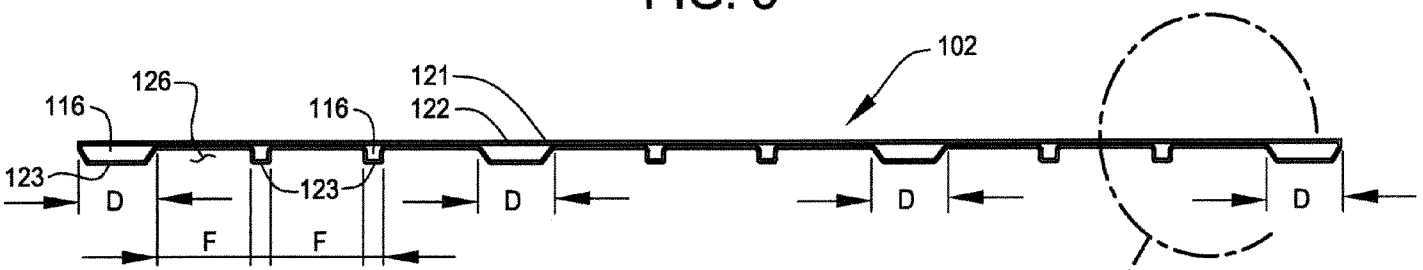
FIG. 4 shows a side view, of the composite roof batten, according to the preferred embodiment of FIG. 1.

FIG. 2 shows a top view, illustrating composite roof batten 102, according to the preferred embodiment of FIG. 1. FIG. 3 shows a bottom view, illustrating composite roof batten 102, according to the preferred embodiment of FIG. 1. FIG. 4 shows a side view of composite roof batten 102, according to the preferred embodiment of FIG. 1. Reference is now made to FIG. 2 through FIG. 4 with continued reference to FIG. 1.

Preferably, composite roof batten 102 comprises at least one elongated bar-like shape, as shown. Preferably, composite roof batten 102 is made up of two major physical elements, preferably comprising a partial encapsulation (sandwiching) of a lightweight but rigid inner core 116 within two relatively "tough" outer cover layers, as shown.

Preferably, core 116 comprises a substantially rigid low-density material having an upper surface portion 118, and lower surface portion 120, as shown. Preferably, upper reinforcing layer 122 is structurally bonded to upper surface portion 118 of core 116. Similarly, lower reinforcing layer 124 is preferably structurally bonded to lower surface portion 120 of core 116. Preferably, lower reinforcing layer 124 is structured and arranged to reinforce lower surface portion 120 of the composite structure. Preferably, upper reinforcing layer 122 is structured and arranged to reinforce upper surface portion 118 of the composite structure.

When composite roof batten 102 is installed as illustrated in FIG. 1, and subjected to normal "in-service" loading, upper reinforcing layer 122 typically supports compression loading while lower reinforcing layer 124 typically supports tension loading. Preferably, core 116 functions to maintain upper reinforcing layer 122 and lower reinforcing layer 124 in relative position to each other (primarily resisting shear forces within the core region), thus reducing the tendency of the overall batten structure to buckle and deflect under load.

The stiffness of composite roof batten 102 is significantly controlled by the thickness and material properties of the selected core material. The substantially rigid low-density material of core 116 preferably comprises at least one expanded foam material, more preferably rigid cellular foam, more preferably at least one cellular foam, most preferably at least one mold-formed Expanded Polystyrene (EPS) material. Compression strength, shear strength, tension strength, flexural strength, stiffness, creep behavior, and other mechanical properties of core 116 depend significantly on the density of the selected EPS material. Thus, depending on the intended application, preferred embodiments of composite roof batten 102 utilize EPS densities ranging from about ¾ pound per cubic foot to about three pounds per cubic foot. Upon reading the teachings of this specification, those of ordinary skill in the art will now understand that, under appropriate circumstances, considering such issues as intended use, cost, etc., other material arrangements, such as utilizing compressed wood-based materials, honeycomb structures, alternate plastic compositions, etc., may suffice.

Preferably, upper reinforcing layer 122 and lower reinforcing layer 124 are firmly adhered to core 116. Preferably, upper reinforcing layer 122 and lower reinforcing layer 124 are firmly adhered to core 116 using at least one bonding compound, most preferably, upper reinforcing layer 122 and lower reinforcing layer 124 are firmly adhered to core 116 using at least one thermoplastic adhesive (hot-melt adhesive). Thus, the above-described preferred bonded assembly produces a relatively lightweight, high-strength composite support structure. Upon reading the teachings of this specification, those of ordinary skill in the art will now understand that, under appropriate circumstances, considering such issues as intended use, cost, advances in adhesive technology, etc., other bonding arrangements, such as reactive adhesives, contact adhesives, etc., may suffice.

Preferably, upper reinforcing layer 122 comprises at least one substantially continuous upper contact surface 121 that preferably functions to supportively contact the bottom surface of roofing tile 104. Preferably, lower reinforcing layer 124 comprises a plurality of lower contact surfaces 123 (at least two), as shown. Preferably, each lower contact surface is structured and arranged to rest on underlayment 106 of roof system 103, as best shown in FIG. 1.

Preferably, composite roof batten 102 comprises at least one, more preferably, a plurality of channels 126 (at least embodying herein at least one moisture and air passage structured and arranged to assist the passage of moisture and air through such at least one composite roof batten), as shown. Preferably, channels 126 comprise a plurality of spaced openings spanning between adjacent sets of lower contact surfaces 123, preferably spaced essentially evenly along longitudinal axis 128, as shown. Preferably, each channel 126 is structured and arranged to assist the passage of moisture and air 112 through composite roof batten 102, also illustrated in FIG. 1.

Preferably, composite roof batten 102 comprises a length A of about 48 inches. Preferably, composite roof batten 102 comprises a width B of about 1½ inches. Preferably, composite roof batten 102 comprises a finished thickness C of about ¾ inch. Upon reading the teachings of this specification, those of ordinary skill in the art will now understand that, under appropriate circumstances, considering such issues as intended use, etc., other thickness arrangements, such as producing a composite assembly having thicknesses up to about three inches, to provide additional air movement under the roof tile, etc., may suffice. Preferably, each channel 126 comprises a width D of between about one inch and about three inches and an open height H of about ½ inch.

Within the preferred length A, a composite roof batten 102 most preferably comprises ten lower contact surfaces 123 and nine channels 126, as shown. Four of the ten lower contact surfaces 123 preferably comprise a length D of about three inches. Preferably, six of the ten lower contact surfaces 123 preferably comprise a length E of about ¾ inches (see enlarged view of FIG. 4). Preferably, six of the ten lower contact surfaces 123 are equally spaced (at about the quarter points) along the length, as shown. Preferably, the six smaller lower contact surfaces 123 are interspersed between adjacent sets of larger contact surfaces 123 such that the maximum span of the spaced openings (between any two contact points) is no less than about one inch and no greater than about four inches. Most preferably, the maximum clear span between any two contact points comprises a distance F of about 3 ½ inches.

Preferably, upper reinforcing layer 122 and lower reinforcing layer 124 each comprise at least one rigid thermoplastic, most preferably at least one Acrylonitrile-Butadine-Styrene (ABS) material. Preferably, upper reinforcing layer 122 and lower reinforcing layer 124 each comprise an initial sheet thickness of between about 0.06 inches and 0.3 inches.

Figure 5:
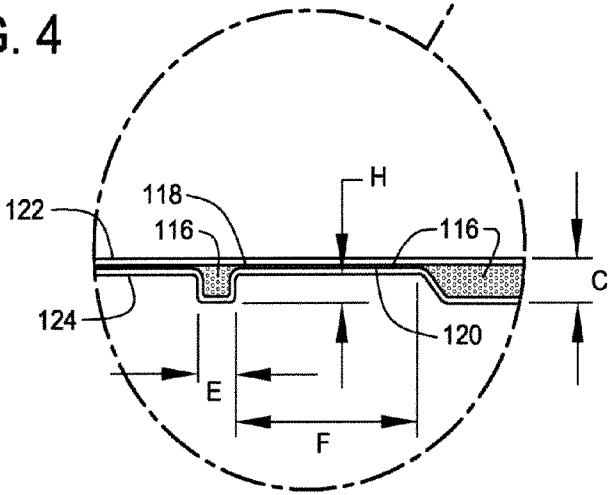
FIG. 5 shows a partial side view, of the composite roof batten with a securing fastener, according to the preferred embodiment of FIG. 1.
Figure 5:
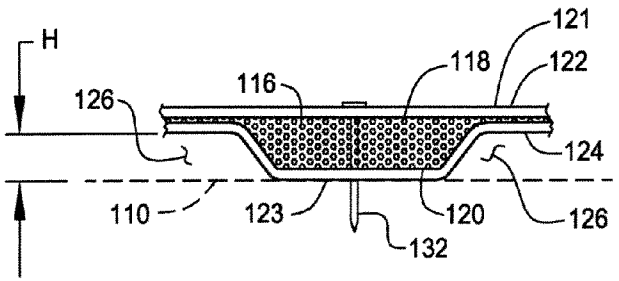

FIG. 5 shows a partial side view of composite roof batten 102 firmly secured to underlayment 106 using fastener 132, according to the preferred embodiment of FIG. 1. Preferably, composite roof batten 102 is firmly secured to roof substrate 110 using at least four fasteners 132. Preferably, each of the four fasteners 132 is approximately centered within one of the four larger lower contact surfaces 123, as shown. Fastener 132 preferably comprises a mechanical-type fastener, preferably a nail, or alternatively preferably, a screw. The preferred structures and arrangements of composite roof batten 102, as described herein, comprise sufficiently mechanical strength to allow for pneumatic nailing or power-driven screwing, preferably using industry-standard tools known in the art.

Figures 6, 7, 8:
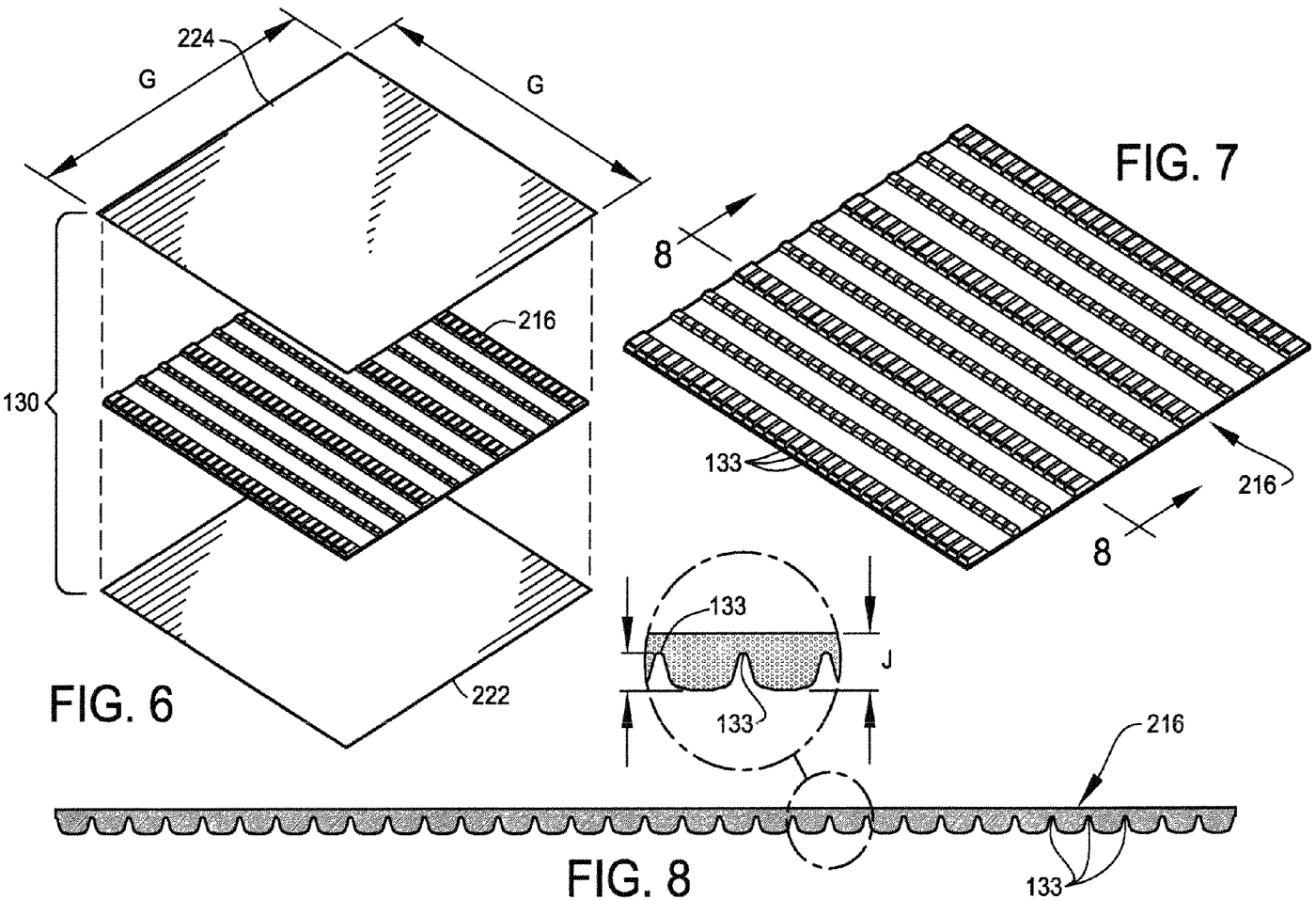
FIG. 6 shows an exploded perspective view, of a composite sheet preferably used to produce a plurality of the composite roof battens, according to a preferred embodiment of the present invention.
FIG. 7 shows a perspective view of the low-density core sheet of FIG. 6.
FIG. 8 shows a sectional view, through section 8-8 of FIG. 7, according to the preferred embodiment of FIG. 7.

FIG. 6 shows an exploded perspective view of an uncut composite sheet 130 preferably used to produce a plurality of composite roof battens 102, according to a preferred embodiment of the present invention. Preferably, composite sheet 130 comprises core sheet 216, upper reinforcing sheet 222, and lower reinforcing sheet 224, as shown. Preferably, each uncut sheet of the depicted composite comprises a generally square outer dimension G of about 48 inches, as shown. Prior to assembly, both upper reinforcing sheet 222 and lower reinforcing sheet 224 preferably comprise a generally smooth and planar conformation, as shown. The uncut low-density core 216 is preferably pre-formed to comprise a plurality of contoured surface shapes, as shown and described in FIG. 7.

FIG. 7 shows a perspective view of the uncut core sheet 216 of FIG. 6. FIG. 8 shows a sectional view, through section 8-8 of FIG. 7, according to the preferred embodiment of FIG. 6. Preferably, the uncut core sheet 216 is pre-formed (preferably mold formed) to comprise contoured surface shapes corresponding to the moisture-passing channels 126 depicted in FIG. 4.

Preferably, core sheet 216 is formed to produce a plurality of composite roof battens 102, as shown. Preferably, each core sheet 216 is molded to produce 32 composite roof battens 102, preferably arranged in 32 essentially identical parallel rows, as shown. Preferably, each individual roof-batten portion of the uncut core sheet 216 is defined by a plurality of parallel channels 133, as shown. Preferably, channels 133 indicate the preferred location of cuts, which will eventually divide the assembled composite sheet 130 into individual composite roof battens 102. Preferably, each channel 133 comprises a depth K of about 9/16 inch.

Figure 9:
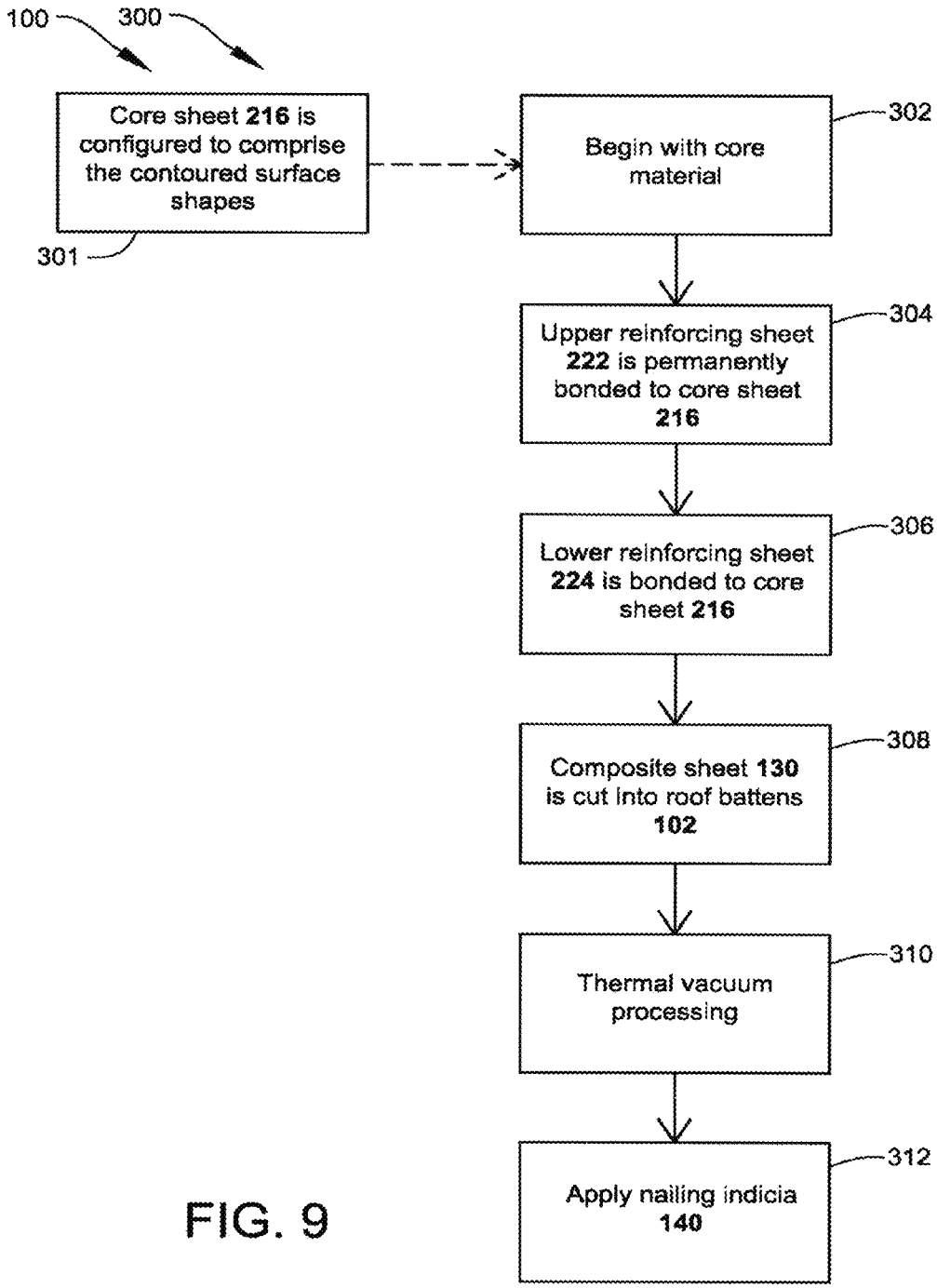
FIG. 9 shows a diagram illustrating the preferred steps of a preferred method enabling the fabrication of a composite sheet producing a plurality of the composite roof battens, according to a preferred method of the present invention.

Preferably, the entire upper reinforcing sheet 222 and lower reinforcing sheet 224 are firmly adhered to low-density core 216, preferably using thermal vacuum-forming process, as describe din FIG. 9. Preferably, composite sheet 130 is formed as a single unit and is then cut into the above-described individual composite roof battens 102.

FIG. 9 shows a diagram illustrating the preferred steps of method 300 enabling the fabrication of composite sheet 130 and a plurality of composite roof battens 102, according to a preferred method of the present invention. Preferably, method 300 comprises the following preferred fabrication steps.

Preferably, a fabrication begins with at least one sheet of substantially rigid low-density core material as indicated in preferred step 302. This material preferably comprises the above-described expanded foam material of core sheet 216. Preferably, upper reinforcing sheet 222 is permanently bonded to upper surface portion 218 of core sheet 216 as indicated in preferred step 304. Preferably, bonding comprises the use of at least one chemical bonder, preferably contact cement; alternatively preferably bonding utilizes at least one thermal (hot-melt) glue. Preferably, lower reinforcing sheet 224 is next bonded to lower surface portion 220 of core sheet 216 as indicated by preferred step 306. This preferred assembly step produces at least one reinforced composite sheet 130, as shown. It is noted that, depending on the selected fabrication technique, the bonding of upper reinforcing sheet 222 and lower reinforcing sheet 224 may preferably occur in a single (essentially simultaneous) step. Next, composite sheet 130 is cut into strips producing the plurality of essentially identical composite roof battens 102, as indicated in preferred step 308.

In a highly preferred initial step (identified herein as preferred initial step 301), core sheet 316 is configured (preferably molded) to comprise the contoured surface shapes corresponding to the moisture-passing channels 126 depicted in FIG. 4. Known methods for molding EPS begin with the step of filling a negative mold with EPS beads. The beads preferably comprise small hollow polystyrene spheres filled with a gas-forming expansion agent, typically a volatile hydrocarbon. The molds are usually made of a heat-resistant material, such as cast aluminum, and most often consist of two separable halves. Each half is preferably mounted onto a platen-type structure, preferably adapted to create a steam cavity adjacent each of the mold portions. Once the mold is filled with beads, steam is used to heat the mold (and beads within the mold cavity) to expand and fuse the beads within the negative cavity to form core sheet 216. Typically, the steam is drawn through vents into the bead-filled mold cavity to facilitate the expansion process.

Furthermore, it is highly preferred that lower reinforcing sheet 224 be formed to lower surface portion 220 using a thermal vacuum process, as indicated in preferred step 310. Preferably, lower reinforcing sheet 224 is heated to a temperature between about 300° F. and 500° F., most preferably about 340° F., and is then brought into contact with the surface of the core material. Preferably, the core material has been pre-treated with at least one bonding agent. Preferably, one or more vacuum ports of the vacuum tool allow a vacuum to be drawn between lower reinforcing sheet 224 and core sheet 216. After the vacuum is drawn, as described above, atmospheric pressure pushes lower reinforcing sheet 224 down toward the surface of core sheet 216. Most preferably, both upper reinforcing sheet 222 and lower reinforcing sheet 224 are applied to core sheet 216 in preferred step 310, preferably using the above-described processes for both sheets.

Applicant has determined that it is preferred to mold core sheet 216 slightly thicker than the intended thickness C of the finished composite roof battens 102. This allows for some reduction of foam thickness that is expected to occur during the thermal vacuum process. Preferably, for the above-described EPS materials, core sheet 216 comprises a nominal thickness J of about one inch. This preferred "compensating" thickness has been found to produce the intended final thickness C (of about ¾ inches) in the final composite. Upon reading the teachings of this specification, those of ordinary skill in the art will now understand that, under appropriate circumstances, considering such issues as intended use, material composition, thermal characteristics of the constituent components, etc., other thickness arrangements, such as greater compensating thicknesses, smaller compensating thicknesses, etc., may suffice.

In alternative preferred step 312, nailing indicia 140 (preferably comprising a printed surface marking structured and arranged to assist a user in properly locating at least one mechanical fastener used to fasten composite roof batten 102 to the roof structure) is preferably applied to outer surface of upper reinforcing layer 122, as best shown in FIG. 2.

Figure 10:
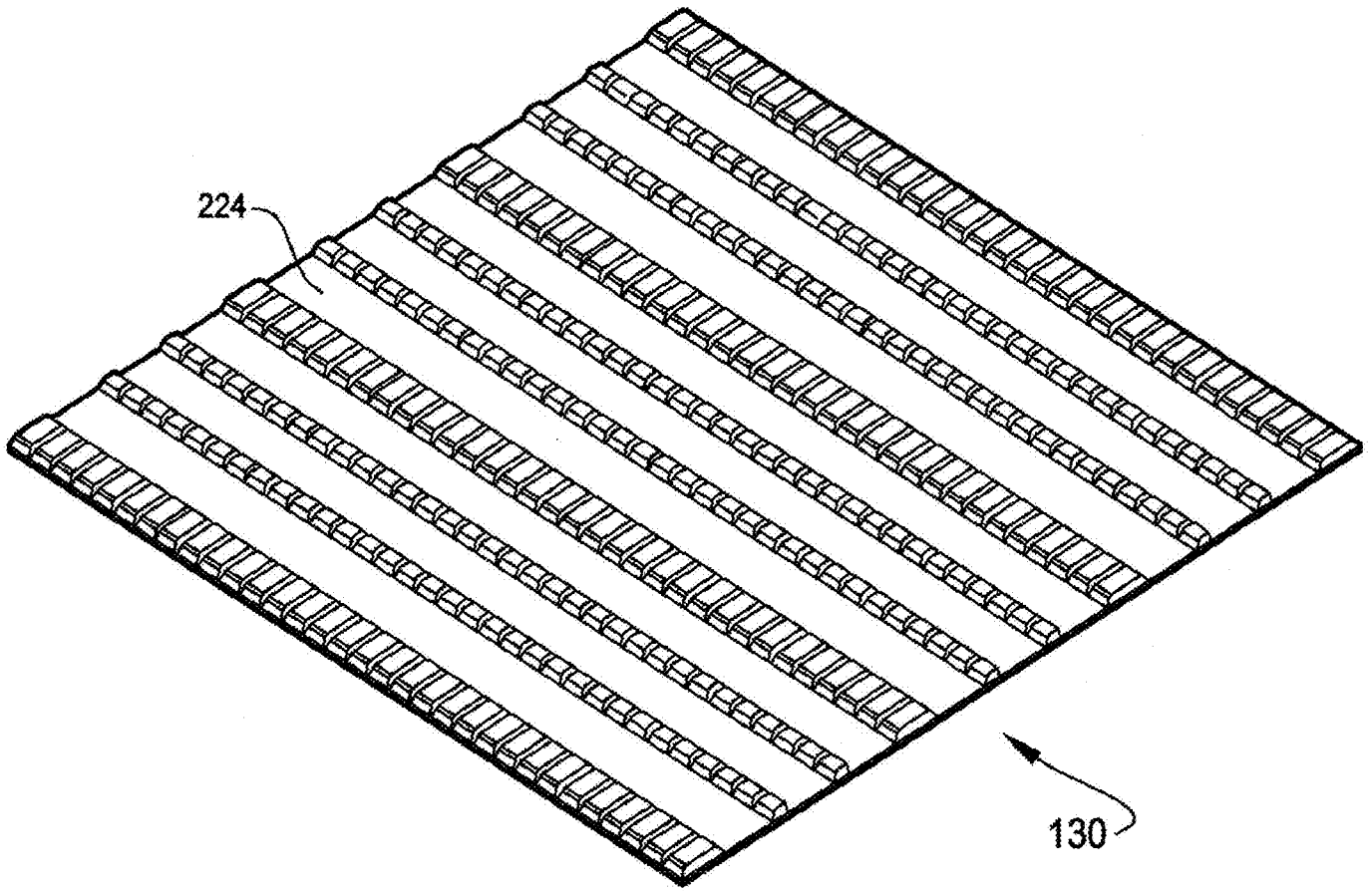
FIG. 10 shows a perspective view of the assembled composite sheet according to the preferred embodiment of FIG. 6.

FIG. 10 shows a perspective view of the assembled composite sheet 130 of FIG. 6.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A system, relating to improving in-service performance of at least one roof assembly utilizing at least one roof tile, said system comprising:

a) at least one composite roof batten structured and arranged to support at least one roof tile over at least one roof structure;

b) wherein said at least one composite roof batten comprises i) at least one substantially rigid low-density core of expanded foam material comprising an elongated bar having a longitudinal axis, an upper surface, a lower surface, and at least one channel formed in the lower surface of the elongated bar, the at least one channel being transverse to the longitudinal axis and forming contours in the lower surface;

ii) at least one upper reinforcing layer overlaying said at least one substantially rigid low-density core, said at least one upper reinforcing layer structured and arranged to reinforce said upper surface of said at least one substantially rigid low-density core, and iii) at least one lower reinforcing layer underlaying said at least one substantially rigid low-density core, said at least one lower reinforcing layer structured and arranged to reinforce said lower surface of said at least one substantially rigid low-density core, said at least one lower reinforcing layer conforming to the lower surface and the contours formed therein by the at least one channel for providing at least one opening between the at least one composite roof batten and the at least one roof structure; and c) wherein said at least one upper reinforcing layer and said at least one lower reinforcing layer are firmly attached to said at least one substantially rigid low-density core.

2. The system according to claim 1 wherein said at least one elongated bar comprises a length of about 48 inches.

3. The system according to claim 2 wherein the at least one opening comprises a width of between about one inch and about four inches.

4. The system according to claim 3 wherein said at least one upper reinforcing layer and said at least one lower reinforcing layer each comprises at least one rigid thermoplastic.

5. The system according to claim 3 wherein said at least one upper reinforcing layer and said at least one lower reinforcing layer each comprises at least one acrylonitrile-butadine-styrene (ABS) material.

6. The system according to claim 3 wherein said at least one expanded foam material comprises at least one expanded polystyrene (EPS) material.

7. A system related to improving in-service performance of at least one roof assembly utilizing at least one roof tile, said system comprising:

a) at least one composite roof batten structured and arranged to support at least one roof tile over at least one roof structure;

b) wherein said at least one composite roof batten comprises i) at least one substantially continuous upper contact surface structured and arranged to supportively contact at least one roof tile, ii) at least two lower contact surfaces each one structured and arranged to contact at least one roof structure, iii) at least one intermediate positioner structured and arranged to maintain the position of said at least one substantially continuous upper contact surface relative to said at least two lower contact surfaces, and iv) at least one passage structured and arranged to assist the passage of moisture and air through said at least one composite roof batten;

c) wherein said at least one moisture passage spans between said at least two lower contact surfaces;

d) wherein said at least one intermediate positioner comprises at least one substantially rigid core material comprising a first material density, said at least one substantially rigid core material is formed of expanded foam having a contoured surface shape being at least one passage and said at least two lower contact surfaces;

e) wherein said at least one substantially continuous upper contact surface and said at least two lower contact surfaces each comprise at least one substantially rigid sheet material having at least one second material density greater than such first material density; and f) wherein each said at least one substantially rigid sheet material is firmly adhered to said at least one substantially rigid core material and follow the contours thereof.

8. The system according to claim 7 wherein said at least one composite roof batten comprises a longitudinal length of about four feet and a transverse width of at least about one inch.

9. The system according to claim 7 wherein said at least one composite roof batten comprises an overall thickness of at least ¾ inch.

10. The system according to claim 7 wherein each one of said at least two lower contact surfaces comprise a longitudinal length of between about ½ inch and about four inches.

11. The system according to claim 7 wherein said at least one moisture passage comprises an opening width of at least three inches and an opening height of at least ½ inch.

12. The system according to claim 7 wherein each said at least one substantially rigid sheet material is firmly adhered to said at least one substantially rigid core material using at least one contact adhesive.

13. The system according to claim 7 wherein each said at least one substantially rigid sheet material is firmly adhered to said at least one substantially rigid core material using at least one hot-melt adhesive.

14. The system according to claim 7 wherein said at least one substantially rigid core material comprises at least one Expanded Polystyrene Foam having a density of between about ¾ pounds per cubic foot and about three pounds per cubic foot.

* * * * *